US009422611B2

(12) United States Patent
Sugita et al.

(10) Patent No.: US 9,422,611 B2
(45) Date of Patent: Aug. 23, 2016

(54) AL—SC ALLOY MANUFACTURING METHOD

(71) Applicant: NIPPON LIGHT METAL COMPANY, LTD., Tokyo (JP)

(72) Inventors: Kaoru Sugita, Shizuoka (JP); Masato Yatsukura, Shizuoka (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 0 days.

(21) Appl. No.: 14/424,348

(22) PCT Filed: Jun. 26, 2013

(86) PCT No.: PCT/JP2013/067503

§ 371 (c)(1),
(2) Date: Feb. 26, 2015

(87) PCT Pub. No.: WO2014/207834

PCT Pub. Date: Dec. 31, 2014

(65) Prior Publication Data

US 2015/0232965 A1 Aug. 20, 2015

(51) Int. Cl.

| | |
|---|---|
| ***C22C 1/02*** | (2006.01) |
| ***C22C 21/00*** | (2006.01) |
| ***C22B 21/06*** | (2006.01) |

(52) U.S. Cl.

CPC ..... *C22C 1/026* (2013.01); *C22B 21/062* (2013.01); *C22C 21/00* (2013.01)

(58) Field of Classification Search

CPC ..... C22C 1/026; C22C 21/00; C22B 21/062
See application file for complete search history.

(56) References Cited

U.S. PATENT DOCUMENTS

2014/0161691 A1* 6/2014 Feraud ..... B01D 11/04 423/5

FOREIGN PATENT DOCUMENTS

| | | | |
|---|---|---|---|
| CN | 100410400 C | * | 8/2008 |
| FR | 2 555 611 A1 | | 5/1985 |

(Continued)

OTHER PUBLICATIONS

Moskvitin et al. Russian patent 2213795 published Oct. 2003. Machine translation.*

(Continued)

*Primary Examiner* — George Wyszomierski
*Assistant Examiner* — Tima M McGuthry Banks
(74) *Attorney, Agent, or Firm* — Birch, Stewart, Kolasch & Birch, LLP

(57) ABSTRACT

Provided is a method of producing an Al—Sc based alloy suitable for production of an Al—Sc based alloy that: eliminates the needs for equipment for heating in an inert gas atmosphere or a vacuum atmosphere, a reducing agent such as metal Ca, and equipment and power for molten salt electrolysis; can be performed adequately by heating up to 1,050° C.; and enables continuous operation. The method of producing an Al—Sc based alloy includes: loading into a reaction vessel metal aluminum (Al), a metal fluoride salt, and a scandium compound; elevating a temperature of a reaction system to from 700 to 1,050° C. to form a molten metal layer including molten metal aluminum serving as a lower layer and a molten salt layer in which the metal fluoride salt and the scandium compound are melted serving as an upper layer; and transferring a scandium ion ($Sc^{3+}$) generated in the molten salt layer side to the molten metal layer side. The metal fluoride salt has a melting temperature lower than the reaction temperature and has a density in a range of from 70 to 95% of the density of the molten metal aluminum, at the reaction temperature.

4 Claims, 1 Drawing Sheet

(56) References Cited

FOREIGN PATENT DOCUMENTS

| | | | |
|---|---|---|---|
| JP | 48-15708 | | 2/1973 |
| JP | 4-131308 | A | 5/1992 |
| JP | 4-235231 | A | 8/1992 |
| JP | 6-172887 | A | 6/1994 |
| JP | 11-50170 | A | 2/1999 |
| JP | 2001-348637 | A | 12/2001 |
| JP | 2003-171724 | A | 6/2003 |
| JP | 2007-254822 | A | 10/2007 |
| RU | 2213795 | C1 * | 10/2003 |

OTHER PUBLICATIONS

Jiashun Jiang et al. Chinese patent 100410400 C published Aug. 2008. Machine translation.*

Haynes, PhD. W.M., editor. CRC Handbook of Chemistry and Physics Internet Version 2016. 96th edition. Various pages.*

Kazuhiro et al. Japanese patent JP 2003171724 A published Jun. 2003. Machine translation.*

Seon, Francoise. French patent 2555611 A1 published May 1985. Machine translation.*

Gary et al. Japanese patent 04235231 A published Aug. 1992. Abstract.*

International Search Report, issued in PCT/JP2013/067503, dated Aug. 20, 2013.

International Preliminary Report on Patentability and Englich translation of the Written Opinion of the International Searching Authority (PCT/IB/326, PCT/IB/373 and PCT/ISA/237) dated Jan. 7, 2016 for Application No. PCT/JP2013/067503.

* cited by examiner

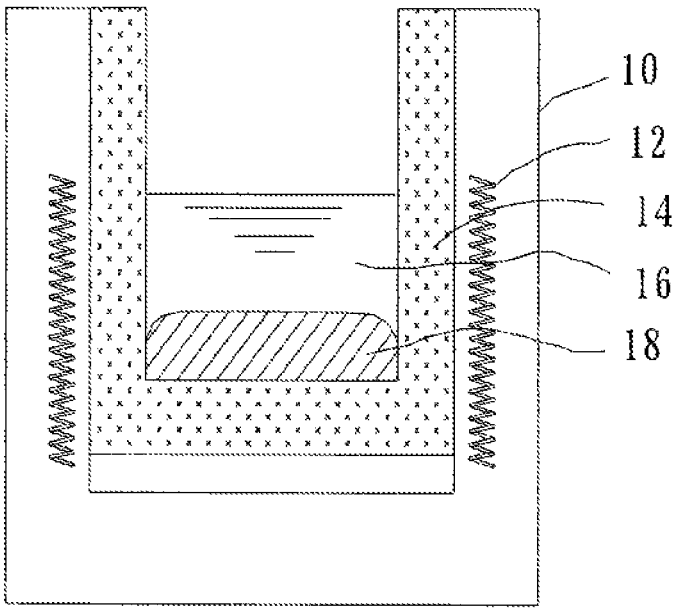
10
12
14
16
18

AL—SC ALLOY MANUFACTURING METHOD

TECHNICAL FIELD

The present invention relates to a method of producing an Al—Sc based alloy suitable for production of an Al—Sc based alloy, and an Al—Sc based alloy obtained by the production method.

BACKGROUND ART

It has been known that addition of scandium (Sc) as an alloy element into aluminum (Al) or its alloy remarkably improves heat resistance. Therefore, in recent years, effective utilization of an aluminum based alloy (Al—Sc based alloy) has been expected in various industrial fields. Specifically, an aluminum based alloy obtained by adding Sc as an alloy element hardly exhibits a reduction in mechanical strength even after maintained at a temperature exceeding 200° C. for a long time period, even when the amount of an added rare earth element is 0.1 mass %. This is likely to be because, in the aluminum based alloy obtained by adding Sc as an alloy element, mechanical properties changed through plastic deformation processing hardly undergoes recovery or recrystallization through heating. For example, Patent Literature 1 introduces that an aluminum alloy material that is useful as a material for an aluminum based alloy wire and exhibits good conductivity, high mechanical strength, and excellent heat resistance can be obtained by incorporating 0.05 to 0.3 mass % of Sc and 0.1 to 0.4 mass % of Zr into a pure Al matrix.

However, such aluminum based alloy containing Sc has hitherto been utilized in extremely limited applications despite the promising utility in industrial fields. The reason for this is that metal Sc is liable to be oxidized and reduction for obtaining metal Sc from a scandium compound (Sc compound) such as a Sc halide or a Sc chalcogenide is associated with difficulties. Specifically, in order to obtain Sc as a metal, there is a need to reduce the Sc compound through heating using as a reducing agent an alkali metal such as Na, an alkaline earth metal such as Ca and Mg, or the like, which are more susceptible to oxidation than Sc, or to reduce the Sc compound through molten salt electrolysis.

For example, Patent Literature 2 discloses a technology for obtaining metal Sc powder, involving loading into a vacuum reaction vessel a Sc halide together with metal Ca, metal Zn, or the like, reducing the Sc halide with metal Ca to form a Sc—Zn alloy, separating the obtained Sc—Zn alloy phase from the halide phase containing an oxide of Ca, followed by pulverization, and further, performing oxidation treatment on the alloy powder obtained through pulverization to form a thin oxide coating on the powder surface, and thereafter, loading the resultant powder into a vacuum vessel containing an inert gas atmosphere, and performing heating under vacuum to vaporize Zn or the like serving as an alloy component. In addition, Patent Literature 3 discloses a technology for producing an aluminum based alloy containing a rare earth element by means of electrolytic reduction. The electrolytic reduction is conducted in a molten salt electrolytic bath mainly containing a fluoride of an alkali metal or an alkaline earth metal and a fluoride of a rare earth element such as Sc, Y, and lanthanoid by using as a cathode molten metal Al floating in an upper layer and protecting an anode with an insulating material so as to prevent the positive electrode from being brought into contact with the molten metal Al in the upper layer.

In the former reduction method through heating, the alkali metal or alkaline earth metal used as a reducing agent is expensive and its handling requires greatest care owing to remarkably high reactivity. Accordingly, there is a problem in that the reducing agent required for reduction cannot be mass-produced easily at low cost. In addition, in the latter reduction method by means of molten salt electrolysis, it is essential to utilize an electrolytic reduction vessel capable of withstanding high temperature exceeding the melting temperature of Al (660° C.), operation at high temperature is difficult for fear of contamination with impurities or the like from the vessel or the like, and the electrolytic reduction needs to be conducted at a temperature equal to or less than the melting temperature of Sc exceeding 1,500° C. (specifically, a temperature of 1,000° C. or less). In addition, there need some efforts to adjust reduction conditions so as to prevent Sc precipitated through reduction from becoming a solid metal to dendritically grow or to prevent Sc precipitated so as to form with another metal an alloy having a low melting temperature from becoming a solid. Further, equipment and power for electrolysis are required, the electrolytic bath externally heated needs to be operated in an inert gas atmosphere such as argon gas (Ar gas) in order that the molten metal Al (negative electrode) in the upper layer is not oxidized, and a time period for the electrolysis needs to be considered so as to prevent the specific gravity (substantially the same as "density") of an generated aluminum alloy from exceeding the specific gravity of the molten salt. Accordingly, mass-production at low cost is not easily realized because of the great deal of labor and higher cost.

In this connection, with a view to producing an aluminum based alloy containing Sc, there have been proposed several technologies involving allowing a Sc compound as it is to react with metal Al to provide an aluminum based alloy containing Sc without conducting a step of reducing Sc from its compound form to a metal form.

For example, Patent Literature 4 discloses a technology for obtaining an aluminum based alloy containing a rare earth element through a reaction between a compound of a rare earth element and aluminum in the presence of a calcium chloride flux.

In addition, Patent Literature 5 discloses a technology for producing an Al—Sc alloy containing Sc at a high content, involving loading into a reaction vessel a Sc halide such as $ScF_3$ and metal Al together with metal Ca serving as a reducing agent and LiF, $CaCl_2$, or the like serving as a flux, performing heating at a temperature of from 800 to 1,000° C. in an inert gas atmosphere to reduce the Sc halide with metal Ca and concurrently allow the Sc halide to be alloyed with metal Al to form an Al—Sc alloy, and then, cooling the resultant at a cooling rate of from 10 to 70° C. per minute to the solidifying temperature of Al or to a temperature 100° C. lower than the solidifying temperature, thereby generating a precipitate with high density Sc and a precipitate with low density Sc in the Al—Sc alloy, and thereafter, separating the precipitate with high density Sc from the precipitate with low density Sc, and subjecting the precipitate with high density Sc to vacuum melting, thereby vaporizing residual metal Ca that is the reducing agent.

Further, Patent Literature 6 discloses a technology for obtaining a light metal alloy containing a rare earth element, involving mixing powder of an oxide or halide of a rare earth element such as Sc and powder of a light metal such as Al or Mg, pelletizing the obtained mixture through compression molding, and then, putting the pellet into a molten light metal bath after enhancing wettability of the surface of the pellet to the molten light metal, and reducing the oxide or halide of a rare earth element with the light metal.

Further, Patent Literature 7 discloses a technology for producing an aluminum based alloy containing a rare earth element that includes Y and lanthanoid that, involving subjecting an oxide of the rare earth element to a reaction with metal Al.

CITATION LIST

Patent Literature

[PTL 1] JP 2001-348637 A
[PTL 2] JP 04-131308 A
[PTL 3] JP 06-172887 A
[PTL 4] JP 48-015708 A
[PTL 5] JP 2003-171724 A
[PTL 6] JP 04-235231 A
[PTL 7] FR 2555611 B1

SUMMARY OF INVENTION

Technical Problem

However, the technology disclosed in Patent Literature 4 has problems as described below. While the compound of a rare earth element serving as a raw material is reduced with metal Al, a reaction temperature in the reduction needs to be 1,200° C. or more, and at such temperature, $AlCl_3$, HCl, or the like having a high vapor pressure vaporizes as a reaction product. Such gas is extremely highly corrosive, which disadvantageously brings about a need for an expensive corrosion resistant material to be used as a crucible material and also brings about restriction on handling such as measures for environmental contamination. Further, consumption of Al through oxidation and necessary heat energy are enormous, which results in lower economic efficiency.

In addition, the technology disclosed in Patent Literature 5 involves reducing the Sc halide with metal Ca serving as a reducing agent in an inert gas atmosphere and then removing by vaporizing residual metal Ca in a vacuum atmosphere. Therefore, there are problems in that metal Ca serving as a reducing agent is needed in a large amount, it is essential to use equipment for heating and melting the raw materials in an inert gas atmosphere and equipment for heating the precipitate with high density Sc in a vacuum atmosphere because the raw materials need to be subjected to a reaction in an inert gas atmosphere and the precipitate with high density Sc in the reaction product Al—Sc alloy needs to be vaporized in a vacuum atmosphere, and hence, it is difficult to reduce cost and improve economic efficiency.

Further, the technology disclosed in Patent Literature 6 has problems as described below. As there is a need to conduct pelletization through compression molding after mixing powder of an oxide or halide of a rare earth element such as Sc and powder of a light metal and enhance wettability of the surface of the pellet to the molten light metal, the production requires a number of steps. Accordingly, it is difficult to reduce cost and improve economic efficiency, as in the technology disclosed in Patent Literature 5.

Further, the technology disclosed in Patent Literature 7 has problems as described below. While the rare earth element includes Y and lanthanoid without Sc, the molten aluminum based alloy containing the rare earth element generated in the course of the reaction is located above aluminum oxide powder, which is another reaction product, to be exposed to an external atmosphere, and therefore, its reaction system needs to be maintained in an inert gas atmosphere and equipment for heating and melting the raw materials in an inert gas atmosphere is required. Accordingly, it is difficult to reduce cost and improve economic efficiency also in the technology disclosed in Patent Literature 7.

The present invention has been devised in view of the foregoing, and an object of the present invention is to provide a method of producing an Al—Sc based alloy suitable for production of an Al—Sc based alloy that: eliminates the needs for equipment for heating in an inert gas atmosphere or a vacuum atmosphere, a reducing agent such as metal Ca, and equipment and power for molten salt electrolysis; can be performed adequately by heating up to 1,050° C.; involves easy and simple production steps; can reduce risks for molten salt consumption and environmental contamination; and enables continuous operation to easily improve economic efficiency.

Solution to Problem

That is, according to one embodiment of the present invention, there is provided a method of producing an Al—Sc based alloy, the method including: loading into a reaction vessel metal aluminum (Al), one kind or two or more kinds of metal fluoride salts selected from the group consisting of an alkali metal fluoride, an alkaline earth metal fluoride, and aluminum fluoride, and a scandium compound including an oxide and/or fluoride salt of scandium (Sc); elevating a temperature of a reaction system in the reaction vessel including the metal aluminum (Al), the metal fluoride salt, and the scandium compound to a reaction temperature to form a molten metal layer including molten metal aluminum and a molten salt layer in which the metal fluoride salt and the scandium compound are melted; and transferring a scandium ion ($Sc^{3+}$) generated on a molten salt layer side to a molten metal layer side, the reaction temperature of the reaction system being set in a range of from 700 to 1,050° C., the metal fluoride salt to be used including a metal fluoride salt having a melting temperature lower than the reaction temperature and having a density in a range of from 70 to 95% of a density of the molten metal aluminum at the reaction temperature of the reaction system, the molten salt layer and the molten metal layer serving as an upper layer and a lower layer, respectively, in the reaction system in the reaction vessel.

According to another embodiment of the present invention, there is provided an Al—Sc based alloy, which is produced by the method described above.

In the present invention, the metal fluoride salt to be loaded into the reaction vessel for forming the molten salt layer is one kind or a mixture of two or more kinds selected from the group consisting of an alkali metal fluoride, an alkaline earth metal fluoride, and aluminum fluoride ($AlF_3$). Examples of the alkali metal fluoride include lithium fluoride (LiF), sodium fluoride (NaF), potassium fluoride (KF), and cesium fluoride (CsF). Examples of the alkaline earth metal fluoride include beryllium fluoride ($BeF_2$), magnesium fluoride ($MgF_2$), and calcium fluoride ($CaF_2$). In view of ensuring the desired reaction temperature of the reaction system (in a range of from 700 to 1,050° C.) and acquiring the desired density at the reaction temperature (in a range of from 70 to 95% of the density of the molten metal Al at the reaction temperature of the reaction system), a mixture of LiF and NaF is preferred. A mixture of LiF and NaF at a mass ratio (LiF:NaF) in a range of from 7:5 to 8:5 is more preferred. A metal fluoride salt formed of such mixture has a melting temperature of from 652 to 675° C., has a density of 1.99 kg/dm$^3$ at 760° C. and 1.88 kg/dm$^3$ at 980° C., and is not compatible with the molten metal Al and the molten Al—Sc alloy forming the molten metal layer when the metal fluoride salt is in a molten state.

Moreover, the scandium compound (Sc compound) to be loaded into the molten salt layer to generate a scandium ion ($Sc^{3+}$) during the reaction is scandium (Sc) oxide ($Sc_2O_3$) and/or scandium (Sc) fluoride salt ($ScF_3$). In view of continuous production of the Al—Sc based alloy, scandium oxide ($Sc_2O_3$) is preferred.

In the present invention, it is necessary that the molten salt layer and the molten metal layer serve as an upper layer and a lower layer, respectively, in the reaction system in the reaction vessel, and thereby, the molten metal layer be not brought into contact with air. The reaction may be conducted under a state in which the reaction system is left still. Alternatively, the reaction may be conducted with stirring the reaction system as required unless the molten metal layer is brought into contact with air. With this, the chemical reaction can be promoted. The reaction temperature of the reaction system is generally set in a range of 700° C. or more and 1,050° C. or less. When the reaction temperature is less than 700° C., the reaction temperature becomes close to the melting temperature of Al (660° C.) and there is a risk in that $Al_3Sc$ is locally generated and the Al—Sc based alloy, which is a reaction product, becomes heterogeneous. In addition, in the case of using scandium (Sc) oxide ($Sc_2O_3$) as the scandium compound (Sc compound), there is a problem in that the solubility of scandium oxide ($Sc_2O_3$) in the molten salt layer is low and hence the speed of the chemical reaction is limited. In contrast, when the reaction temperature exceeds 1,050° C., there are problems in that enormous heat energy is required, an expensive heat resistant material needs to be used for the reaction vessel, and further, the molten salt has a higher vapor pressure and vaporization loss becomes enormous, resulting in an increase in the cost and restriction on handling such as measures for environmental contamination.

Further, in the molten salt layer, in which the metal fluoride salt and the scandium compound are melted, to be formed in the reaction vessel at the reaction temperature of the reaction system, the molten salt has a density at the reaction temperature of the reaction system in a range of preferably 70% or more and 95% or less of the density of the molten metal aluminum at the reaction temperature of the reaction system. For achieving the density of less than 70%, there is a need to add lithium fluoride, which has a high melting temperature (mp: 848° C.) and is expensive, at a high blending ratio, which brings about a problem of lower economic efficiency. In contrast, when the density is higher than 95%, there are problems in that the density of the molten salt increases as the Sc compound dissolves and thereby the density of the molten salt layer becomes higher than the density of the molten metal layer, which causes the molten metal layer to be exposed above the molten salt layer to be brought into contact with air. Thus, the molten metal reacts with oxygen in air to be oxidized, which results in a lower yield of the Al—Sc alloy, which is the target product.

Further, in order to generate a scandium ion ($Sc^{3+}$) on the molten salt layer side of the reaction system formed in the reaction vessel, metal aluminum (Al), the metal fluoride salt, and the Sc compound may be loaded into the reaction vessel, followed by the elevation of the temperature to the reaction temperature, to form the reaction system. Alternatively, metal aluminum (Al) and the metal fluoride salt may be loaded into the reaction vessel, followed by the elevation of the temperature to the reaction temperature, to preliminarily form the molten metal layer and the molten salt layer, respectively, and after that, the scandium ion ($Sc^{3+}$) may be generated in the molten salt layer by adding the Sc compound into the molten salt layer.

Advantageous Effects of Invention

The method of producing an Al—Sc alloy according to one embodiment of the present invention eliminates the needs for equipment for heating in an inert gas atmosphere or a vacuum atmosphere, a reducing agent such as metal Ca, and equipment and power for molten salt electrolysis, can be performed adequately by heating up to 1,050° C., involves easy and simple production steps, can reduce risks for molten salt consumption and environmental contamination, and enables continuous operation to easily improve economic efficiency.

BRIEF DESCRIPTION OF DRAWING

FIG. 1 is an explanatory diagram illustrating an example of a production apparatus to be utilized in carrying out the present invention.

DESCRIPTION OF EMBODIMENTS

In the present invention, metal Al, a metal fluoride salt, and a Sc compound are loaded into a reaction vessel, and the resultant reaction system in the reaction vessel is heated at a reaction temperature in a range of from 700 to 1,050° C. to be melted, thus forming a molten metal layer and a molten salt layer. The metal fluoride salt is adjusted to have a density of from 70 to 95% of the density of molten metal Al at the reaction temperature. Accordingly, the molten metal Al layer having a lower Sc concentration and the molten salt layer are formed at a lower portion and upper portion of the reaction system, respectively, so as to be brought into contact with each other. In this case, the following chemical reaction represented by the reaction formula (1) takes place at an interface between the molten salt layer and the molten metal layer.

$$Sc^{3+}/(s)+Al/(m) \leftrightarrows Sc/(m)+Al^{3+}/(s) \quad (1)$$

(In the reaction formula (1), "/(s)" represents an element or ion in the molten salt layer and "/(m)" represents an element or ion in the molten metal layer.)

The direction of the reaction represented by the reaction formula (1) at the interface between the molten salt layer and the molten metal layer is determined by a difference in free energy of formation between a Sc salt and an Al salt as well as by $Sc^{3+}$ ion activity and $Al^{3+}$ ion activity in the molten salt layer and Sc activity in the molten metal Al. Now, when the $Sc^{3+}$ ion activity in the molten salt layer is high and the $Al^{3+}$ ion activity in the molten salt layer and the Sc activity in the molten metal are low and hence the reaction proceeds in the right direction owing to the difference in the activities, the molar number of Sc that is reduced to be alloyed with the molten metal Al is equal to the molar number of an $Al^{3+}$ ion that is oxidized from the molten metal Al to be ionized and dissolved in the molten salt layer. As the reaction proceeds, the concentration of metal Sc increases in the molten metal Al and the concentration of the $Al^{3+}$ ion increases in the molten salt layer.

Such changes in the activities are changes in a direction toward termination of the reaction. Finally, the activities come to a state of equilibrium and then the reaction terminates. In the scope of the present invention, the activities of ions associated with the reaction formula (1) are each approximately proportional to the corresponding ion concentration. Accordingly, in order that the reaction of the reaction formula (1) proceeds in the right direction and thus the Al—Sc based alloy is efficiently produced, there is a need to keep the concentration of the $Sc^{3+}$ ion ($Sc^{3+}$ concentration) in terms of molar percentage (mol %) in the molten salt layer high and keep the concentration of the $Al^{3+}$ ion ($Al^{3+}$ concentration) in terms of molar percentage (mol %) in the molten salt layer low before the reaction. In addition, there is a need to keep the concentration of Sc (Sc concentration) in terms of molar percentage (mol %) in the molten metal layer low before the reaction.

In the present invention, in order that the reaction of the reaction formula (1) proceeds in the right direction, the reaction temperature of the reaction system is set to from 700 to 1,050° C., the molten salt layer having a melting temperature lower than the reaction temperature is formed in the reaction vessel, and the molten metal layer in a molten state at the reaction temperature is formed beneath the molten salt layer in the reaction vessel so as to be brought into contact with the molten salt layer. The Sc compound is loaded into the molten salt layer to be dissolved therein and thus the $Sc^{3+}$ ion concentration in the molten salt layer is increased. The $Sc^{3+}$ ion reacts at an interface with the molten metal layer having a lower Sc concentration formed in contact with the molten salt layer. Thus, the molten metal layer is alloyed. In this context, according to the present invention, it is possible to suppress oxidation of the Al—Sc alloy, which is a reaction product, without using an inert gas atmosphere or a vacuum atmosphere for the reaction system because the molten salt layer is present above the molten metal layer. Moreover, it is possible to suppress vaporization from the molten salt layer as much as possible and reduce the risks for molten salt consumption and environmental contamination because the reaction temperature of the reaction system is set to from 700 to 1,050° C. Further, the present invention enables continuous operation and continuous production of the product, and thus economic efficiency can be easily improved.

In the present invention, the reaction of the reaction formula (1) proceeds continuously in the right direction when the $Sc^{3+}$ concentration in the molten salt layer is kept high, the Sc concentration in the molten metal Al is kept low, and the $Al^{3+}$ ion generated in the molten salt layer forms a compound having a low solubility in the molten salt and thereby the $Al^{3+}$ concentration in the molten salt layer does not become high. Herein, the reaction formula (1) depends on the $Al^{3+}$ concentration and $Sc^{3+}$ concentration in the molten salt layer when the Sc concentration in the molten metal layer is constant, but changes depending on the kind of the molten salt, the kind of the Sc compound serving as a raw material, the reaction temperature, and the like. Therefore, the Sc concentration that is finally transferred into the molten metal layer and incorporated as an alloy element differs even when the concentrations of the ions are the same.

In addition, in the present invention, in order to continuously produce the Al—Sc alloy by the chemical reaction represented by the reaction formula (1), it is necessary to maintain the relationship among a target Sc concentration $F_{Sc}$ of an alloy element Sc in the target product Al—Sc based alloy after the reaction, a $Sc^{3+}$ concentration $P_{Sc}$ in the molten salt layer serving as a raw material, and a Sc concentration $C_{Sc}$ of a rare earth metal in the molten metal Al before the reaction as represented by the following relational formula (2). That is, when the conditions as represented by the relational formula (2) are adopted in the reaction system of the present invention, the Sc compound in the molten salt layer can be efficiently subjected to a reaction with the molten metal Al to be alloyed therewith and thus the Al—Sc alloy can be produced.

$$0 \leq (F_{Sc} - C_{Sc})/P_{Sc} \leq 1.5 \quad (2)$$

The method of producing an Al—Sc based alloy of the present invention is hereinafter described in more detail with reference to the attached drawing.

FIG. 1 illustrates a schematic diagram according to an example of a production apparatus for conducting the method of producing an Al—Sc based alloy of the present invention. The production apparatus includes a reaction vessel 14 and a heating furnace 10 that surrounds the reaction vessel 14 and includes a heater 12 therein. The heater 12 is capable of heating the reaction vessel 14 up to at least 1,050° C. In addition, the reaction vessel 14 and the heating furnace 10 are formed of materials capable of withstanding a temperature of at least 1,050° C. Further, the reaction vessel 14 is as required equipped with stirring means such as a stirring blade not illustrated in FIG. 1 for stirring the reaction system to the extent that the molten metal layer is not brought into contact with air.

In the present invention, for example, the metal fluoride salt formed of a mixture of LiF and NaF at a weight ratio (LiF:NaF) in the range of from 7:5 to 8:5 (mixed salt) is loaded into the reaction vessel 14, and heated to a reaction temperature selected from 700 to 1,050° C. to be melted, thus forming a molten salt layer 16. At the same time, metal Al is loaded into the reaction vessel 14, and heated to the reaction temperature to be melted, thus forming a molten metal layer 18. Thus, the molten metal layer 18 coexists with the molten salt layer 16. Now, because metal Al has a melting temperature of 660° C. and molten metal Al has a density of 2.36 kg/dm$^3$ and 2.28 kg/dm$^3$ at 760° C. and 980° C., respectively, the density of a molten mixed salt obtained by melting the mixed salt [1.99 kg/dm$^3$ (760° C.) and 1.88 kg/dm$^3$ (980° C.)] are 84% and 82% of that of the molten metal Al, respectively. Accordingly, in the reaction vessel 14, the molten salt layer 16 and the molten metal layer 18 are separated from each other, and the molten salt layer 16 serves as an upper layer and the molten metal layer 18 serves as a lower layer.

Subsequently, while the reaction vessel 14 is maintained at the reaction temperature, the Sc compound is loaded into the reaction vessel 14 to be dissolved in the molten salt layer 16, thus generating the $Sc^{3+}$ ion in the molten salt layer 16. For example, when the target Al—Sc based alloy to be yielded is an Al-1.2 mol % Sc alloy, the yield amount of the alloy is 1.0 mole, and the molten metal layer 18 to serve as a raw material does not include Sc, the amount of Al required for the molten metal layer 18 to serve as a raw material is determined as 1.0 mole based on the reaction formula (1). For satisfying the relational formula (2), the $Sc^{3+}$ concentration in the molten salt layer 16 to serve as a raw material needs to satisfy the relationship of $(0.012/1.5) \leq P_{Sc} \leq (0.012/0.3)$, that is, of $0.008 \leq P_{Sc} \leq 0.04$, given that $F_{Sc}=0.012$ and $C_{Sc}=0$. In this case, the $Sc^{3+}$ concentration in the molten salt layer 16 needs to be set to from 0.8 to 4.0 mol %.

As the Sc compound loaded into the reaction vessel 14 dissolves, the $Sc^{3+}$ concentration in the molten salt layer 16 increases and concurrently the density of the molten salt layer 16 increases. However, when the $Sc^{3+}$ concentration in the molten salt layer 16 is up to about 5 mol %, the increase in the density is up to about 0.02 kg/dm$^3$. The increase in the density (0.02 kg/dm$^3$) corresponds to up to 1% of the density of the molten metal Al. Accordingly, when the density of the molten salt layer 16 is from 70 to 95% of the density of the molten metal layer 18, the density of the molten salt layer 16 does not exceed the density of the molten metal layer 18. Thus, in the reaction vessel 14, the molten metal layer 18 is not exposed above the molten salt layer 16 to be brought into contact with air.

When the reaction vessel 14 is maintained at the reaction temperature in the above-mentioned range, the $Sc^{3+}$ ion in the molten salt layer 16 undergoes the chemical reaction with the molten metal Al at an interface with the molten metal layer 18 formed beneath the molten salt layer 16 in the reaction vessel 14. The $Sc^{3+}$ ion is reduced through the chemical reaction and alloyed with the molten metal Al. In this case, the reaction system may be preferably stirred to the extent that the molten metal layer 18 is not brought into contact with air, because the stirring promotes the chemical reaction represented by the reaction formula (1). Alternatively, the reaction system may be left still without any stirring.

The $Al^{3+}$ ion generated through the chemical reaction of the reaction formula (1) dissolves in the molten salt layer 16, and thereby, the $Al^{3+}$ concentration in the molten salt layer 16 increases. On the other hand, in the molten metal layer 18 that is formed beneath the molten salt layer 16 so as to be brought into contact with the molten salt layer, Sc dissolves therein up to a value satisfying the relational formula (2) with respect to the $Al^{3+}$ concentration in the molten salt layer 16 within its solubility limit, and thus a molten Al—Sc based alloy is formed. The molten metal Al gradually changes into the molten Al—Sc based alloy.

According to the studies conducted by the inventors of the present invention, such chemical reaction takes place at from 700 to 1,050° C. In addition, oxidation of the Al—Sc based alloy, which is a reaction product, can be suppressed without adopting an inert gas atmosphere or a vacuum atmosphere, because the surface of the molten metal layer 18 is protected by the molten salt layer 16 by virtue of adjusting the density of the molten salt in a predetermined range lower than the density of the molten metal Al. Further, according to the chemical reaction of the reaction formula (1), the density of the molten salt layer 16 decreases, whereas the density of the molten metal layer 18 increases, as the reaction proceeds. Accordingly, there is no need to conduct procedures such as stopping electrical current for adjusting the densities (or specific gravities) of the layers in the middle of the chemical reaction unlike the case of Patent Literature 3. Thus, the operation is simple and easy.

After the molten Al—Sc based alloy is formed through the chemical reaction of the reaction formula (1), the molten metal layer 18 is collected from the reaction vessel. The collection method is not particularly limited as long as the molten metal layer 18 can be taken out of the reaction vessel 14, and any appropriate method heretofore known can be adopted. Specifically, there may be adopted a method selected from: a method involving tilting the reaction vessel 14 and selectively dropping the molten metal layer 18; a method involving selectively scooping the molten metal layer 18 with a ladle; a method involving selectively vacuuming up the molten metal layer 18 with a vacuum pump; a method involving selectively discharging the molten metal layer 18 from an outlet port preliminarily provided at the bottom of the reaction vessel 14 not illustrated in FIG. 1; and the like.

Moreover, in the present invention, it is possible to continuously produce the molten Al—Sc based alloy by such operation that the reaction system satisfies the relationship represented by the relational formula (2). In this case, after collecting the generated molten Al—Sc based alloy, metal Al and the Sc compound may be additionally loaded into the reaction vessel 14 while the reaction vessel 14 is maintained at the reaction temperature in the predetermined range, and then, melted with the molten salt layer 16 remaining in the reaction vessel 14. Then, the Sc compound additionally loaded into the reaction vessel 14 dissolves in the molten salt of the molten salt layer 16 to generate a $Sc^{3+}$ ion, and the generated $Sc^{3+}$ ion reacts with the molten metal Al concurrently loaded into the reaction vessel 14 and melted to form the molten metal layer 18. Thus, the chemical reaction of the reaction formula (1) proceeds again and the molten metal Al is alloyed, and thereby a molten Al—Sc based alloy is formed. By repeating such production steps, the molten Al—Sc based alloy can be continuously produced.

When such production of the Al—Sc based alloy is continuously repeated, the $Al^{3+}$ concentration in the molten salt layer 16 gradually increases. However, in the case of using $Sc_2O_3$ as the Sc compound, the $Al^{3+}$ ion in the molten salt layer 16 is oxidized to $Al_2O_3$. $Al_2O_3$ hardly dissolves in both of the molten metal layer 18, which is formed of the molten Al—Sc based alloy, and in the molten salt layer 16, which is formed of the molten metal fluoride salt. Therefore, $Al_2O_3$ separates from both of the molten metal layer 18 and the molten salt layer 16 in the reaction vessel 14, and hence can be easily discharged from the reaction system. Specifically, by using $Sc_2O_3$ as the Sc compound, the reaction by-product $Al_2O_3$ can be easily discharged from the reaction system and the operation for continuous production of the Al—Sc based alloy becomes easier.

EXAMPLES

Hereinafter, the present invention is described in more detail by way of Examples and Comparative Examples. However, the present invention is by no means limited to Examples and Comparative Examples.

Example 1

A metal fluoride salt obtained by mixing LiF and NaF in amounts as shown in Table 1 was loaded into a reaction vessel, and heated to 960° C. to be melted, thus forming a molten salt layer. Next, metal Al in an amount as shown in Table 2 was loaded into the reaction vessel, and was melted to form a molten metal layer. The molten salt layer and the molten metal layer were present in the reaction vessel under a state in which the molten metal layer and the molten salt layer were separated from each other as a lower layer and an upper layer, respectively, and were in contact with each other.

Further, while the reaction vessel was maintained at 960° C., 0.080 mole of $Sc_2O_3$ was loaded therein as a Sc compound as shown in Table 2 and dissolved in the molten salt layer. Thus, a reaction system of the reaction formula (1) was constructed. The reaction system was maintained at 960° C. for 180 minutes while being stirred to the extent that the molten metal layer was not brought into contact with air. Thus, the chemical reaction of the reaction formula (1) was conducted. After visually confirming that an amount of $Al_2O_3$ generated through the reaction became constant, the reaction was stopped.

After the completion of the reaction, the molten metal layer was collected and analyzed. As a result, it was found that the molten metal layer included 0.063 mole of Sc, which corresponded to an Al-1.57 mass % Sc alloy as compared to an Al amount, and the value of $(F_{Sc}-C_{Sc})/P_{Sc}$ in this case was 0.790, as shown in Table 3. At the completion of the chemical reaction, solid $Al_2O_3$ was generated on the upper surface of the molten salt layer.

Example 2

The same procedures as in Example 1 were performed except that, after constructing the reaction system by the same manner as in Example 1, the reaction system was maintained at 960° C. for 15 minutes and then cooled to 760° C., and after that, was maintained at 760° C. for 180 minutes while being stirred to the extent that the molten metal layer was not brought into contact with air, thereby conducting the chemical reaction of the reaction formula (1).

After the completion of the reaction, the molten metal layer was collected and analyzed by the same manner as in Example 1. As a result, it was found that the molten metal layer included 0.070 mole of Sc, which corresponded to an Al-1.74 mass % Sc alloy as compared to an Al amount, and the value of $(F_{Sc}-C_{Sc})/P_{Sc}$ was 0.878, as shown in Table 3. At the completion of the chemical reaction, solid $Al_2O_3$ was generated on the upper surface of the molten salt layer.

Example 3

The reaction was conducted under the same conditions as in Example 1 except that: the molten salt layer was used in half an amount of that in Example 1; metal Al was used in the same amount as that in Example 1; and $Sc_2O_3$ was used as a Sc compound in half an amount of that in Example 1. The resultant molten metal layer was collected and analyzed. As a result, it was found that the molten metal layer included 0.027 mole of Sc, which corresponded to an Al-0.68 mass % Sc alloy as compared to an Al amount, and the value of $(F_{Sc}-C_{Sc})/P_{Sc}$, was 0.339, as shown in Table 3. At the completion of the chemical reaction, solid $Al_2O_3$ was generated on the upper surface of the molten salt layer.

Example 4

The reaction of the reaction formula (1) was conducted by the same manner as in Example 1 except that: a metal fluoride salt obtained by mixing LiF and NaF in amounts as shown in Table 1 was loaded into a reaction vessel to form a molten salt layer; 6.671 moles of metal Al were loaded into the reaction vessel to form a molten metal layer as shown in Table 2; and 0.160 mole of $ScF_3$ was loaded therein as a Sc compound as shown in Table 2, to construct a reaction system.

After the completion of the reaction, the resultant molten metal layer was collected and analyzed as in Example 1. As a result, it was found that the molten metal layer included 0.079 mole of Sc, which corresponded to an Al-1.95 mass % Sc alloy as compared to an Al amount, and the value of $(F_{Sc}-C_{Sc})/P_{Sc}$ was 1.469, as shown in Table 3. Further, at the completion of the chemical reaction, no floating solid was observed on the upper surface of the molten salt layer.

Comparative Example 1

A reaction system was constructed under the same conditions as in Example 1 except that metal Al in Example 1 was changed to an Al-3.00 mass % Sc based alloy formed of 6.471 moles of Al and 0.120 mole of Sc, and the reaction was similarly conducted.

After the completion of the reaction, the resultant molten metal layer was collected and analyzed. As a result, it was found that the amount of Sc was 0.098 mole, which was lower than the amount of Sc before the reaction and corresponded to an Al-2.45 mass % Sc alloy as compared to an Al amount, and the value of $(F_{Sc}-C_{Sc})/P_{Sc}$ was −0.323, as shown in Table 3. At the completion of the chemical reaction, solid $Al_2O_3$ was generated on the upper surface of the molten salt layer. A possible reason for the negative value of $(F_{Sc}-C_{Sc})/P_{Sc}$ is that the Sc concentration in the molten metal layer was already high at the time of the loading of 0.080 mole of $Sc_2O_3$ as a Sc compound.

Example 5

A reaction system was constructed under the same conditions as in Example 1 except that: LiF and NaF were used in amounts as shown in Table 1; metal Al was used in an amount shown in Table 2; and 0.160 mole of $Sc_2O_3$ was used as a Sc compound, and the reaction was similarly conducted.

After the completion of the reaction, the molten metal layer was collected and analyzed. As a result, it was found that the molten metal layer included 0.127 mole of Sc, which corresponded to an Al-3.10 mass % Sc alloy as compared to an Al amount, and the value of $(F_{Sc}-C_{Sc})/P_{Sc}$ was 0.980, as shown in Table 3. At the completion of the chemical reaction, solid $Al_2O_3$ was generated on the upper surface of the molten salt layer.

Example 6

At first, a reaction system was constructed under the same conditions as in Example 5 as shown in Tables 1 and 2, and the reaction was similarly conducted. The resultant molten metal layer included 0.124 mole of Sc and thus a molten Al—Sc based alloy layer corresponding to an Al-3.02 mass % Sc alloy was formed, as shown in Table 3. In this case, the value of $(F_{Sc}-C_{Sc})/P_{Sc}$ was 0.957. At the completion of the chemical reaction, solid $Al_2O_3$ was generated on the upper surface of the molten salt layer.

At the completion of the first chemical reaction, 0.196 mole of a $Sc^{3+}$ ion was supposed to remain in the molten salt layer. Then, $Al_2O_3$ generated on the upper surface of the molten salt layer was removed and the reaction system was cooled to 950° C. After that, 6.671 moles of metal Al were additionally loaded into the resultant molten salt after removal of $Al_2O_3$, and was melted to form a molten metal layer. The second chemical reaction was conducted under the same conditions as in the first reaction except that the reaction temperature was set to 950° C. The molten metal layer generated through the second reaction included 0.082 mole of Sc and thus a molten Al—Sc based alloy layer corresponding to an Al-2.02 mass % Sc alloy was formed, as shown in Table 3. In this case, the value of $(F_{Sc}-C_{Sc})/P_{Sc}$ was 0.983. At the completion of the second chemical reaction, solid $Al_2O_3$ was generated on the upper surface of the molten salt layer.

Further, at the completion of the second chemical reaction, 0.114 mole of a $Sc^{3+}$ ion was supposed to remain in the molten salt layer. Then, $Al_2O_3$ generated on the upper surface of the molten salt layer was removed while maintaining the molten salt layer at 950° C. After that, 6.671 moles of metal Al were additionally loaded therein, and melted to form a molten metal layer for the third time. At the same time, 0.043 mole of $Sc_2O_3$ was additionally loaded therein as a Sc compound. Thus, a reaction system in which the amount of Sc was adjusted to 0.200 mole was constructed, and the third chemical reaction was conducted under the same conditions as in the second reaction.

After the completion of the third chemical reaction, the resultant molten metal layer was collected and analyzed. As a result, it was found that the molten metal layer generated through the third reaction included 0.076 mole of Sc, which corresponded to an Al-1.89 mass % Sc alloy as compared to an Al amount, and the value of $(F_{Sc}-C_{Sc})/P_{Sc}$ was 0.893, as shown in Table 3. At the completion of the third chemical reaction, solid $Al_2O_3$ was generated on the upper surface of the molten salt layer.

Example 7

A metal fluoride salt obtained by mixing LiF and NaF in amounts as shown in Table 1 was heated to 960° C. in a reaction vessel to be melted, thus forming a molten salt layer. Next, as shown in Table 2, 6.671 moles of metal Al were loaded into the reaction vessel, and melted to form a molten metal layer. Further, 0.080 mole of $Sc_2O_3$ was loaded in the reaction vessel as a Sc compound while maintaining the reaction vessel at 960° C. The resultant reaction system was maintained at 960° C. for 15 minutes while being stirred to the extent that the molten metal layer was not brought into contact with air. Thus, the chemical reaction of the reaction formula (1) was conducted.

After the completion of the reaction, the molten metal layer was collected and analyzed. As a result, it was found that the molten metal layer included 0.053 mole of Sc, which corresponded to an Al-1.31 mass % Sc alloy as compared to an Al amount, and the value of $(F_{Sc}-C_{Sc})/P_{Sc}$ was 0.596, as shown in Table 3. At the completion of the chemical reaction, solid $Al_2O_3$ was generated on the upper surface of the molten salt layer.

Example 8

As shown in Table 1, a metal fluoride salt obtained by mixing 1.700 moles of NaF, 0.104 mole of $CaF_2$, and 0.831 mole of $AlF_3$ was heated to 960° C. in a reaction vessel to be melted, thus forming a molten salt layer. Next, as shown in Table 2, 6.671 moles of metal Al were loaded into the reaction vessel, and melted to form a molten metal layer. Further, 0.094 mole of $Sc_2O_3$ was loaded in the reaction vessel as a Sc compound while maintaining the reaction vessel at 960° C. The resultant reaction system was maintained at 980° C. for 180 minutes while being stirred to the extent that the molten metal layer was not brought into contact with air. Thus, the chemical reaction of the reaction formula (1) was conducted.

After the completion of the reaction, the molten metal layer was collected and analyzed. As a result, it was found that the molten metal layer included 0.055 mole of Sc, which corresponded to an Al-1.36 mass % Sc alloy as compared to an Al amount, and the value of $(F_{Sc}-C_{Sc})/P_{Sc}$ was 0.329, as shown in Table 3. At the completion of the chemical reaction, solid $Al_2O_3$ was generated on the upper surface of the molten salt layer.

Comparative Example 2

As shown in Table 1, a metal fluoride salt obtained by mixing 2.316 moles of LiF, 1.252 moles of NaF, 0.323 mole of KF, and 0.321 mole of $BaF_2$ was heated to 960° C. in a reaction vessel to be melted, thus forming a molten salt layer. Next, as shown in Table 2, 6.671 moles of metal Al were loaded into the reaction vessel, and melted to form a molten metal layer. In the reaction vessel, the molten metal layer and the molten salt layer were separated from each other, but the molten metal layer was exposed above the molten salt layer as an upper layer and was in contact with air.

Next, while the reaction vessel was maintained at 960° C., 0.080 mole of $Sc_2O_3$ was loaded therein as a Sc compound and was dissolved in the molten salt layer serving as a lower layer. Thus, the reaction system of the reaction formula (1) was constructed. The reaction system was maintained as it was at 980° C. for 180 minutes. Thus, the chemical reaction of the reaction formula (1) was conducted. After visually confirming that the amount of $Al_2O_3$ generated through the reaction became constant, the reaction was stopped.

After the completion of the reaction, the metal layer was collected and analyzed. As a result, it was found that the metal layer included 0.032 mole of Sc, which corresponded to an Al-0.87 mass % Sc alloy as compared to an Al amount, and the value of $(F_{Sc}-C_{Sc})/P_{Sc}$ was 0.283, as shown in Table 3. A possible reason for the value of $(F_{Sc}-C_{Sc})/P_{Sc}$ of less than 0.3 is that the molten metal layer was exposed above the molten salt layer to be brought into contact with air, and then oxidized.

Comparative Example 3

As shown in Table 1, a metal fluoride salt obtained by mixing 2.333 moles of NaF, 2.091 moles of $CaF_2$, and 2.333 moles of $AlF_3$ was heated to 960° C. in a reaction vessel to be melted, thus forming a molten salt layer. Next, as shown in Table 2, 6.671 moles of metal Al were loaded into the reaction vessel, and melted to form a molten metal layer. In the reaction vessel, the molten metal layer and the molten salt layer were separated from each other and the molten metal layer was present as a lower layer beneath the molten salt layer so as to be brought into contact with the molten salt layer.

Further, while the reaction vessel was maintained at 960° C., 0.160 mole of $ScF_3$ was loaded therein as a Sc compound and was dissolved in the molten salt layer serving as an upper layer. Thus, the reaction system of the reaction formula (1) was constructed. The reaction system was maintained at 900° C. for 180 minutes while being stirred to the extent that the molten metal layer was not brought into contact with air. Thus, the chemical reaction of the reaction formula (1) was conducted. As $Al_2O_3$ was not generated in this reaction, the same maintaining time period as in Example 1 was adopted.

After the completion of the reaction, the molten metal layer was collected and analyzed. As a result, it was found that the metal layer included 0.011 mole of Sc, which corresponded to an Al-0.28 mass % Sc alloy as compared to an Al amount, and the value of $(F_{Sc}-C_{Sc})/P_{Sc}$ was 0.216, as shown in Table 3. A possible reason for the value of $(F_{Sc}-C_{Sc})/P_{Sc}$, of less than 0.3 is a higher $Al^{3+}$ concentration in the molten salt layer.

Comparative Example 4

As shown in Table 1, a metal fluoride salt obtained by mixing 2.203 moles of LiF, 1.478 moles of NaF, and 0.428 mole of $AlF_3$ was heated to 960° C. in a reaction vessel to be melted, thus forming a molten salt layer. Next, as shown in Table 2, 6.671 moles of metal Al were loaded into the reaction vessel, and melted to form a molten metal layer. In the reaction vessel, the molten metal layer and the molten salt layer were separated from each other and the molten metal layer was present as a lower layer beneath the molten salt layer so as to be brought into contact with the molten salt layer.

Further, while the reaction vessel was maintained at 960° C., 0.080 mole of $ScF_3$ was loaded therein as a Sc compound and was dissolved in the molten salt layer serving as an upper layer. Thus, the reaction system of the reaction formula (1) was constructed. The reaction system was maintained at 960° C. for 180 minutes while being stirred to the extent that the molten metal layer was not brought into contact with air. Thus, the chemical reaction of the reaction formula (1) was conducted. As $Al_2O_3$ was not generated in this reaction, the same maintaining time period as in Example 1 was adopted.

After the completion of the reaction, the molten metal layer was collected and analyzed. As a result, it was found that the metal layer included 0.013 mole of Sc, which corresponded to an Al-0.67 mass % Sc alloy as compared to an Al amount, and the value of $(F_{Sc}-C_{Sc})/P_{Sc}$ was 0.229, as shown in Table 3. A possible reason for the value of $(F_{Sc}-C_{Sc})/P_{Sc}$ of less than 0.3 is that the Sc compound loaded into the molten salt layer was $ScF_3$ and hence $AlF_3$ soluble in the molten salt was generated as a reaction by-product, followed by a relative decrease in the $Sc^{3+}$ concentration in the molten salt layer owing to the formation of $AlF_3$.

TABLE 1

| | Composition of molten salt layer (molar amount) | | | | | |
|---|---|---|---|---|---|---|
| | LiF | NaF | KF | $BaF_2$ | $CaF_2$ | $AlF_3$ |
| Example 1 | 3.917 | 2.578 | — | — | — | — |
| Example 2 | 3.917 | 2.578 | — | — | — | — |
| Example 3 | 1.958 | 1.289 | — | — | — | — |
| Example 4 | 5.791 | 3.811 | — | — | — | — |
| Example 5 | 4.683 | 3.156 | — | — | — | — |
| Example 6 | 4.683 | 3.156 | — | — | — | — |
| Example 7 | 3.491 | 2.314 | — | — | — | — |

TABLE 1-continued

| | Composition of molten salt layer (molar amount) | | | | | |
|---|---|---|---|---|---|---|
| | LiF | NaF | KF | $BaF_2$ | $CaF_2$ | $AlF_3$ |
| Example 8 | — | 1.700 | — | — | 0.104 | 0.831 |
| Comparative Example 1 | 3.917 | 2.578 | — | — | — | — |
| Comparative Example 2 | 2.316 | 1.252 | 0.323 | 0.321 | — | — |
| Comparative Example 3 | — | 2.333 | — | — | 2.091 | 2.333 |
| Comparative Example 4 | 2.203 | 1.478 | — | — | — | 0.428 |

The symbol "—" means that the content is zero.

TABLE 2

| | Sc compound | | | | Molten metal layer | | | |
|---|---|---|---|---|---|---|---|---|
| | $ScF_3$ (molar amount) | $Sc_2O_3$ (molar amount) | $Sc^{3+}$ (molar amount) | $Sc^{3+}$ concentration in molten salt layer (mol %) ($P_{sc}$) | Metal composition | Al (molar amount) | Sc (molar amount) | Sc concentration (mol %) ($C_{sc}$) |
| Example 1 | — | 0.080 | 0.160 | 1.195 | Pure Al | 6.671 | — | — |
| Example 2 | — | 0.080 | 0.160 | 1.195 | Pure Al | 6.671 | — | — |
| Example 3 | — | 0.040 | 0.080 | 1.195 | Pure Al | 6.671 | — | — |
| Example 4 | 0.160 | — | 0.160 | 0.806 | Pure Al | 6.671 | — | — |
| Example 5 | — | 0.160 | 0.320 | 1.942 | Pure Al | 6.671 | — | — |
| Example 6 | — | 0.160 | 0.320 | 1.942 | Pure Al | 6.671 | — | — |
| | — | — | 0.196 | 1.251 | Pure Al | 6.671 | — | — |
| | — | 0.043 | 0.200 | 1.276 | Pure Al | 6.671 | — | — |
| Example 7 | — | 0.080 | 0.160 | 1.332 | Pure Al | 6.671 | — | — |
| Example 8 | — | 0.094 | 0.188 | 2.505 | Pure Al | 6.671 | — | — |
| Comparative Example 1 | — | 0.080 | 0.160 | 1.195 | Al—Sc alloy | 6.471 | 0.120 | 1.854 |
| Comparative Example 2 | — | 0.080 | 0.160 | 1.750 | Pure Al | 6.671 | — | — |
| Comparative Example 3 | 0.160 | — | 0.160 | 0.765 | Pure Al | 6.671 | — | — |
| Comparative Example 4 | 0.080 | — | 0.080 | 0.852 | Pure Al | 6.671 | — | — |

The symbol "—" means that the content is zero.

TABLE 3

| | Chemical reaction condition | | Sc amount in reaction product Al—Sc alloy | | | |
|---|---|---|---|---|---|---|
| | Temperature (° C.) | Reaction time (min) | Molar amount | Sc concentration (mol %) ($F_{sc}$) | mass % | $(F_{Sc} - C_{Sc})/P_{Sc}$ |
| Example 1 | 960 | 180 | 0.063 | 0.944 | 1.57 | 0.790 |
| Example 2 | 960→760 | 15→180 | 0.070 | 1.049 | 1.74 | 0.878 |
| Example 3 | 960 | 180 | 0.027 | 0.405 | 0.68 | 0.339 |
| Example 4 | 960 | 180 | 0.079 | 1.184 | 1.95 | 1.469 |
| Example 5 | 960 | 180 | 0.127 | 1.904 | 3.10 | 0.980 |
| Example 6 | 960 | 180 | 0.124 | 1.859 | 3.02 | 0.957 |
| | 950 | 180 | 0.082 | 1.229 | 2.02 | 0.983 |
| | 950 | 180 | 0.076 | 1.139 | 1.89 | 0.893 |
| Example 7 | 960 | 15 | 0.053 | 0.794 | 1.31 | 0.596 |
| Example 8 | 980 | 180 | 0.055 | 0.824 | 1.36 | 0.329 |
| Comparative Example 1 | 960 | 180 | 0.098 | 1.469 | 2.50 | −0.323 |
| Comparative Example 2 | 960 | 180 | 0.032 | 0.495 | 0.87 | 0.283 |
| Comparative Example 3 | 900 | 180 | 0.011 | 0.165 | 0.28 | 0.216 |
| Comparative Example 4 | 960 | 180 | 0.013 | 0.195 | 0.32 | 0.229 |

INDUSTRIAL APPLICABILITY

The method of the present invention can be suitably used as a method of producing an Al—Sc based alloy, because the method eliminates the needs for equipment for heating in an inert gas atmosphere or a vacuum atmosphere, a reducing agent such as metal Ca, and equipment and power for molten salt electrolysis, can be performed adequately by heating up to 1,050° C., and involves easy and simple production steps.

REFERENCE SIGNS LIST

10 heating furnace, 12 heater, 14 reaction vessel, 16 molten salt layer, 18 molten metal layer

The invention claimed is:

1. A method of producing an Al—Sc based alloy, the method comprising:

loading into a reaction vessel metal aluminum (Al), one or more metal fluoride salts selected from the group consisting of: an alkali metal fluoride; an alkaline earth metal fluoride; and aluminum fluoride, and a scandium compound comprising an oxide and/or fluoride salt of scandium (Sc);

elevating a temperature of a reaction system in the reaction vessel comprising the metal aluminum (Al), the metal fluoride salt, and the scandium compound to a reaction temperature to form a molten metal layer comprising molten metal aluminum and a molten salt layer in which the metal fluoride salt is melted and the scandium compound is dissolved to generate a scandium ion ($Sc^{3+}$); and transferring the scandium ion ($Sc^{3+}$) generated on a molten salt layer side to a molten metal layer side, the reaction temperature of the reaction system being set in a range of from 700 to 1,050° C., the metal fluoride salt to be used comprising a metal fluoride salt having a melting temperature lower than the reaction temperature and having a density in a range of from 70 to 95% of a density of the molten metal aluminum at the reaction temperature of the reaction system, the molten salt layer and the molten metal layer serving as an upper layer and a lower layer, respectively, in the reaction system in the reaction vessel, wherein the alkaline earth metal fluoride is selected from the group consisting of $BeF_2$, $MgF_2$ and $CaF_2$.

2. A method of producing an Al—Sc based alloy according to claim 1, the method comprising:

loading into a reaction vessel metal aluminum (Al) and a metal fluoride salt;

elevating a temperature to a reaction temperature to form a molten metal layer and a molten salt layer; and thereafter, adding a scandium compound into the molten salt layer to generate a scandium ion ($Sc^{3+}$) in the molten salt layer.

3. A method of producing an Al—Sc based alloy according to claim 1, wherein the metal fluoride salt comprises a mixture of lithium fluoride and sodium fluoride.

4. A method of producing an Al—Sc based alloy according to claim 1, wherein the reaction system in the reaction vessel satisfies a relationship of $0.3 \leq (F_{Sc}-C_{Sc})/P_{Sc} \leq 1.5$, where $F_{Sc}$ represents a target Sc concentration in the Al—Sc based alloy in terms of molar percentage (mol %), $P_{Sc}$ represents a $Sc^{3+}$ concentration in the molten salt layer in terms of molar percentage, and $C_{Sc}$ represents a Sc concentration in the molten metal layer in terms of molar percentage.

* * * * *